US009464816B1

(12) United States Patent
Marks

(10) Patent No.: US 9,464,816 B1
(45) Date of Patent: Oct. 11, 2016

(54) ATTIC VENTILATION SYSTEM

(76) Inventor: Michael D. Marks, Apollo Beach, FL (US)

( * ) Notice: Subject to any disclaimer, the term of this patent is extended or adjusted under 35 U.S.C. 154(b) by 1031 days.

(21) Appl. No.: 13/317,667

(22) Filed: Oct. 25, 2011

Related U.S. Application Data

(60) Provisional application No. 61/406,742, filed on Oct. 26, 2010.

(51) Int. Cl.
*F24F 7/06* (2006.01)
*F24F 7/02* (2006.01)

(52) U.S. Cl.
CPC ..... *F24F 7/025* (2013.01)

(58) Field of Classification Search
CPC ..... F24F 7/025; F24F 7/06; F24F 7/065; F04D 25/12
USPC ..... 454/341–345, 354, 900
See application file for complete search history.

(56) References Cited

U.S. PATENT DOCUMENTS 4,261,255 A * 4/1981 Anderson et al. ..... 454/354
6,159,093 A * 12/2000 Mihalko, III ..... 454/341
6,185,880 B1 * 2/2001 Richardson ..... 454/364
6,386,969 B1 * 5/2002 O'Brien ..... 454/343
6,786,815 B1 * 9/2004 Folsom ..... 454/345
6,966,156 B2 * 11/2005 Dixon ..... 454/364
7,290,980 B2 * 11/2007 Gatley et al. ..... 415/126
7,507,151 B1 * 3/2009 Parker et al. ..... 454/341
8,181,604 B1 * 5/2012 Avila ..... 119/448
8,740,678 B2 * 6/2014 Railkar et al. ..... 454/341
2005/0191957 A1 * 9/2005 Demetry et al. ..... 454/341
2008/0187433 A1 * 8/2008 Hopkins ..... 454/256
2009/0203308 A1 * 8/2009 O'Hagin et al. ..... 454/341
2010/0330898 A1 * 12/2010 Daniels ..... 454/365
2012/0045983 A1 * 2/2012 Eskola, III ..... 454/341
2012/0252348 A1 * 10/2012 Rheaume ..... 454/343
2013/0040553 A1 * 2/2013 Potter ..... 454/341
2013/0074428 A1 * 3/2013 Allen et al. ..... 454/365

* cited by examiner

*Primary Examiner* — Alissa Tompkins
*Assistant Examiner* — Phillip E Decker

(57) ABSTRACT

A housing has a base and upstanding interior and exterior side walls and end walls. A plurality of apertures are in the interior wall. The side walls are formed with outwardly facing flanges positionable upon a roof. A plurality of fans are coupled to the interior side wall in alignment with associated apertures. A power assembly includes cables coupling the fans to a source of potential whereby the fans when activated cause a flow of warm air from the attic and through the housing and through the fan and into the ridge vent and through the holes of the intermediate section and to atmosphere.

1 Claim, 5 Drawing Sheets

FIG. 1
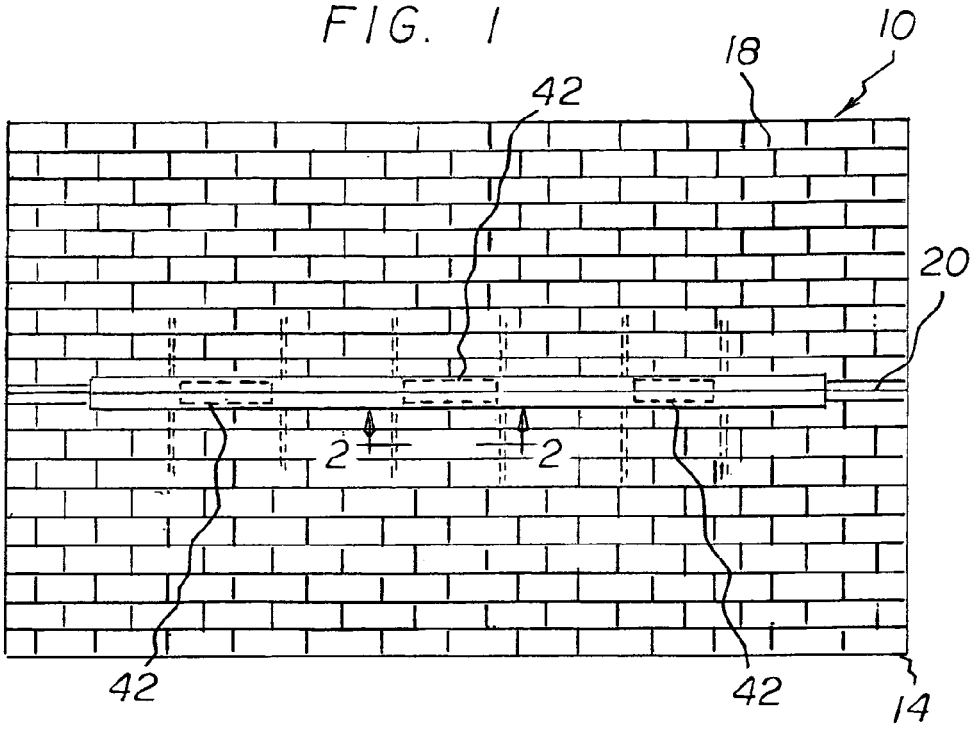
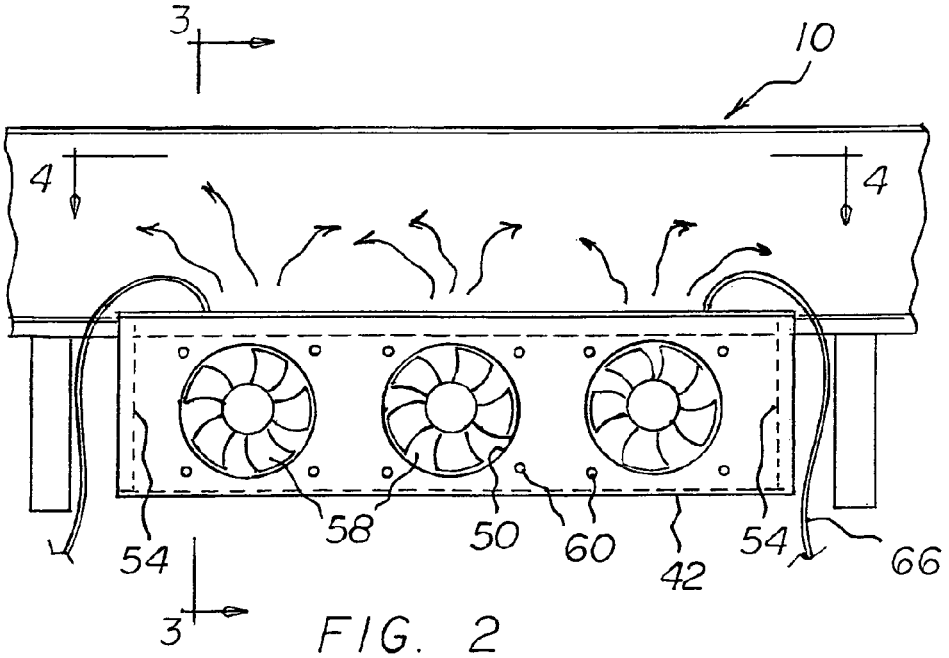
FIG. 2

FIG. 3
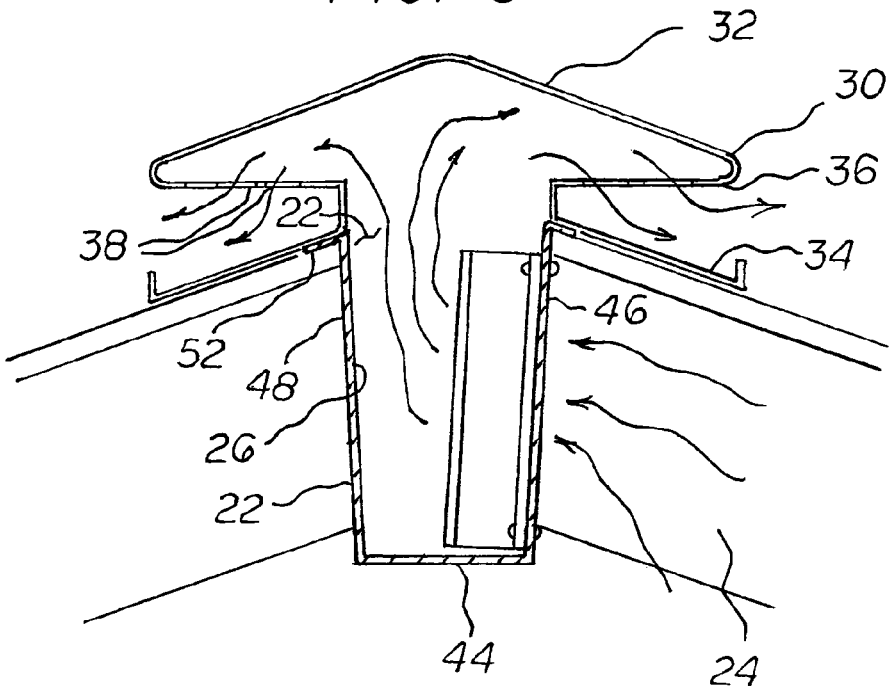
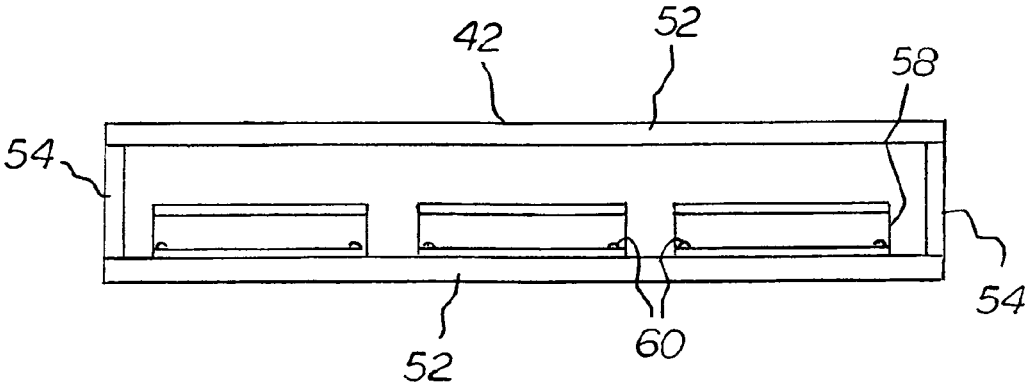
FIG. 4

FIG. 5
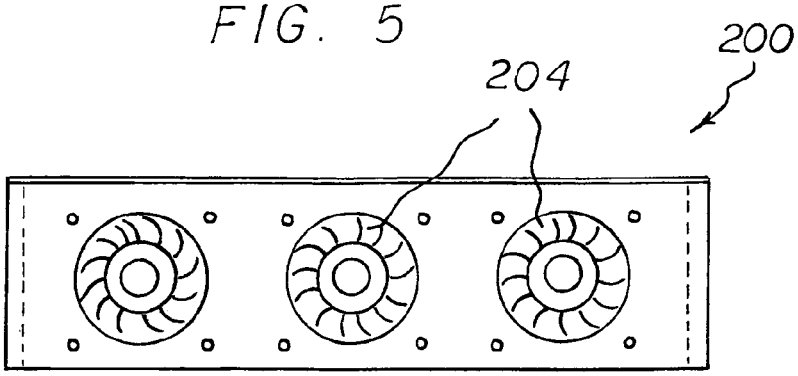
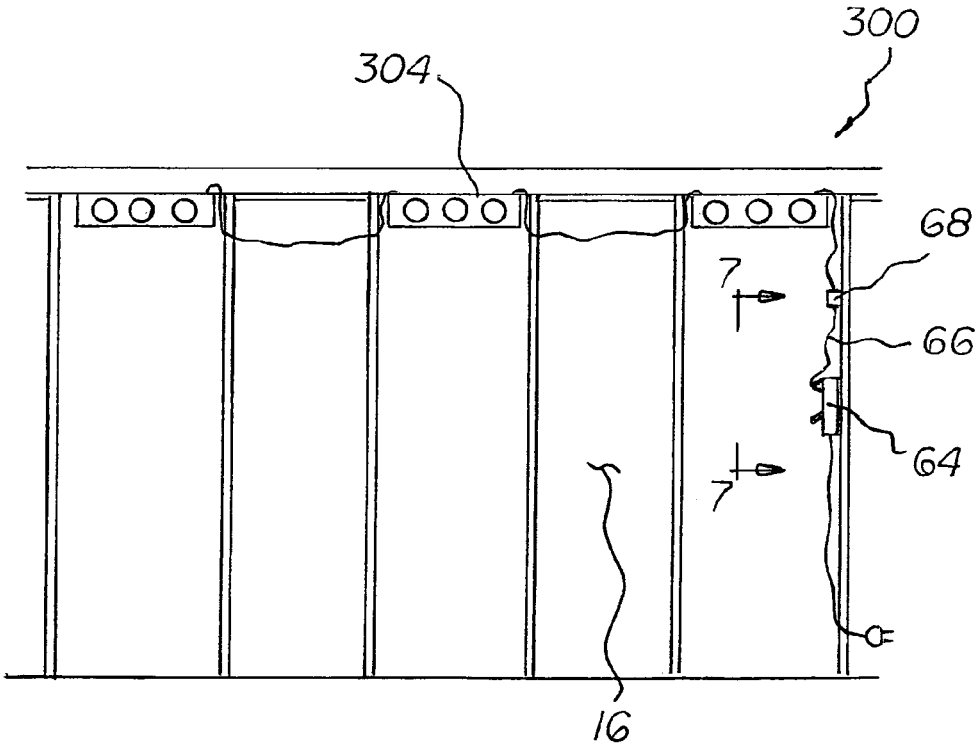
FIG. 6

FIG. 7
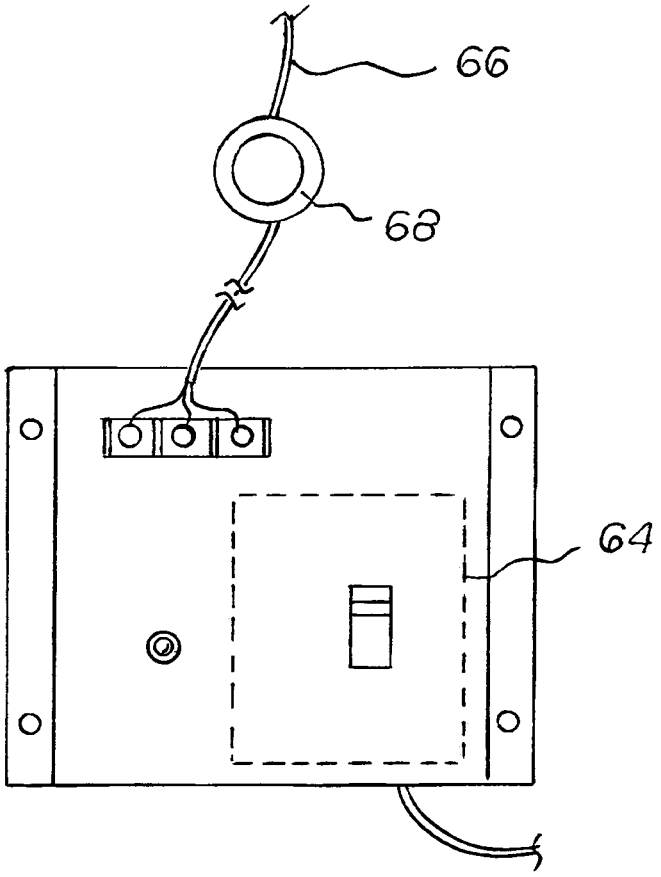
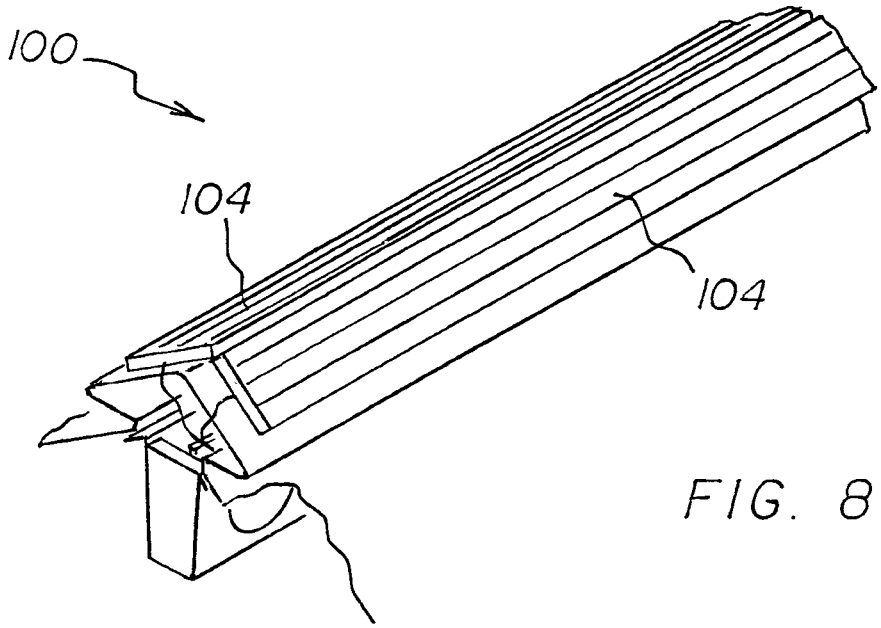
FIG. 8

ATTIC VENTILATION SYSTEM

RELATED APPLICATION

The present non-provisional patent application is based upon Provisional Patent Application No. 61/406,742 filed Oct. 26, 2010, the priority of which is hereby claimed and the subject matter of which is incorporated herein by reference.

BACKGROUND OF THE INVENTION

1. Field of the Invention

The present invention relates to an attic ventilation system and more particularly pertains to evacuating hot air from an attic space of a building through a roof ridge vent and maintaining the attic space at a reduced temperature for abating the need for air conditioning with attendant power consumption, the evacuating and maintaining and abating being done in a safe, convenient and economical manner.

2. Description of the Prior Art

The use of attic ventilation systems of known designs and configurations is known in the prior art. More specifically, attic ventilation systems of known designs and configurations previously devised and utilized for the purpose of evacuating hot air from an attic space are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe an attic ventilation system that allows evacuating hot air from an attic space of a building through a roof ridge vent and maintaining the attic space at a reduced temperature for abating the need for air conditioning with attendant power consumption, the evacuating and maintaining and abating being done in a safe, convenient and economical manner.

In this respect, the attic ventilation system according to the present invention substantially departs from the conventional concepts and designs of the prior art, and in doing so provides an apparatus primarily developed for the purpose of evacuating hot air from an attic space of a building through a roof ridge vent and maintaining the attic space at a reduced temperature for abating the need for air conditioning with attendant power consumption, the evacuating and maintaining and abating being done in a safe, convenient and economical manner.

Therefore, it can be appreciated that there exists a continuing need for a new and improved attic ventilation system which can be used for evacuating hot air from an attic space of a building through a roof ridge vent and for maintaining the attic space at a reduced temperature for abating the need for air conditioning with attendant power consumption, the evacuating and maintaining and abating being done in a safe, convenient and economical manner. In this regard, the present invention substantially fulfills this need.

SUMMARY OF THE INVENTION

In view of the foregoing disadvantages inherent in the known types of attic ventilation systems of known designs and configurations now present in the prior art, the present invention provides an improved attic ventilation system. As such, the general purpose of the present invention, which will be described subsequently in greater detail, is to provide a new and improved attic ventilation system and method which has all the advantages of the prior art and none of the disadvantages.

To attain this, the present invention essentially comprises a building. The building has an attic with a roof there above. The roof has a ridge. An opening is provided along at least a part of the ridge for the passage of warm air from the attic to exterior of the building. The roof is formed with trusses having facing edges adjacent to and spanning the ridge.

Next provided is a ridge vent formed with an imperforate top in an inverted V-shaped configuration above the opening to abate precipitation from entering the attic through the opening. The ridge vent has outwardly extending legs below the opening positioned upon and supported by the roof and spanning the opening. Generally horizontal intermediate sections couple the top and the legs. The intermediate sections are formed with holes to allow the flow of warm air there through.

Next provided is a plurality of similarly configured housings in axial alignment and positioned within the opening. Each housing is formed with a horizontally oriented rectangular base and with upstanding first and second side walls. A plurality of laterally spaced circular apertures are provided in each first side wall for the flow of warm air there through. The base and the side walls are imperforate except for the apertures. The first and second walls are angled outwardly from the base at an angle of less than 5 degrees from vertical. The side walls are formed with outwardly facing flanges positionable upon and supported by the roof and spanning the opening and beneath the legs of the ridge vent. The base and the side walls and the flanges are fabricated of aluminum. Each housing has parallel end walls fabricated of a foam elastomer. The housing is adapted to be contracted during installation to facilitate placement into the opening.

Next provided is a plurality of tube-axial microfans. Fasteners secure each microfan to the interior side wall of an associated housing. The microfans are in alignment with an associated aperture.

Lastly, a power assembly is provided. The power assembly includes a source of potential and cables coupling the fans in series to the source of potential. A thermostat couples the source of potential and the fans to activate and inactivate the fans. The fans when inactivated restrict the flow of warm air. The fans when activated cause a flow of warm air from the attic and through the apertures in the housing and through the fan and into the ridge vent and through the holes of the intermediate section and to atmosphere.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved attic ventilation system which has all of the advantages of the prior art attic ventilation systems of known designs and configurations and none of the disadvantages.

It is another object of the present invention to provide a new and improved attic ventilation system which may be easily and efficiently manufactured and marketed.

It is further object of the present invention to provide a new and improved attic ventilation system which is of durable and reliable constructions.

An even further object of the present invention is to provide a new and improved attic ventilation system which is susceptible of a low cost of manufacture with regard to both materials and labor, and which accordingly is then susceptible of low prices of sale to the consuming public, thereby making such attic ventilation system economically available to the buying public.

Even still another object of the present invention is to provide an attic ventilation system for evacuating hot air from an attic space of a building through a roof ridge vent and for maintaining the attic space at a reduced temperature for abating the need for air conditioning with attendant power consumption, the evacuating and maintaining and abating being done in a safe, convenient and economical manner.

Lastly, it is an object of the present invention to provide a new and improved attic ventilation system with a housing having a base and upstanding interior and exterior side walls and end walls. A plurality of apertures are in the interior wall. The side walls are formed with outwardly facing flanges positionable upon a roof. A plurality of fans are coupled to the interior side wall in alignment with associated apertures. A power assembly includes cables coupling the fans to a source of potential whereby the fans when activated cause a flow of warm air from the attic and through the housing and through the fan and into the ridge vent and through the holes of the intermediate section and to atmosphere.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred and alternate embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of an attic ventilation system constructed in accordance with the principles of the present invention.

FIG. 2 is a cross sectional view of one module taken along line 2-2 of FIG. 1.

FIGS. 3 and 4 are cross sectional views taken along lines 3-3 and 4-4 of FIG. 2.

FIG. 5 is a front elevational view of a module with fans constructed in accordance with an alternate embodiment of the invention.

FIG. 6 is a front elevational view of plural modules coupled together with cables for operation and use.

FIG. 7 is a front elevational view taken along line 7-7 of FIG. 6.

FIG. 8 is a perspective illustration of the system of the prior Figures installed on a linear roof section.

The same reference numerals refer to the same parts throughout the various Figures.

DESCRIPTION OF THE PREFERRED EMBODIMENT

Figure 9:
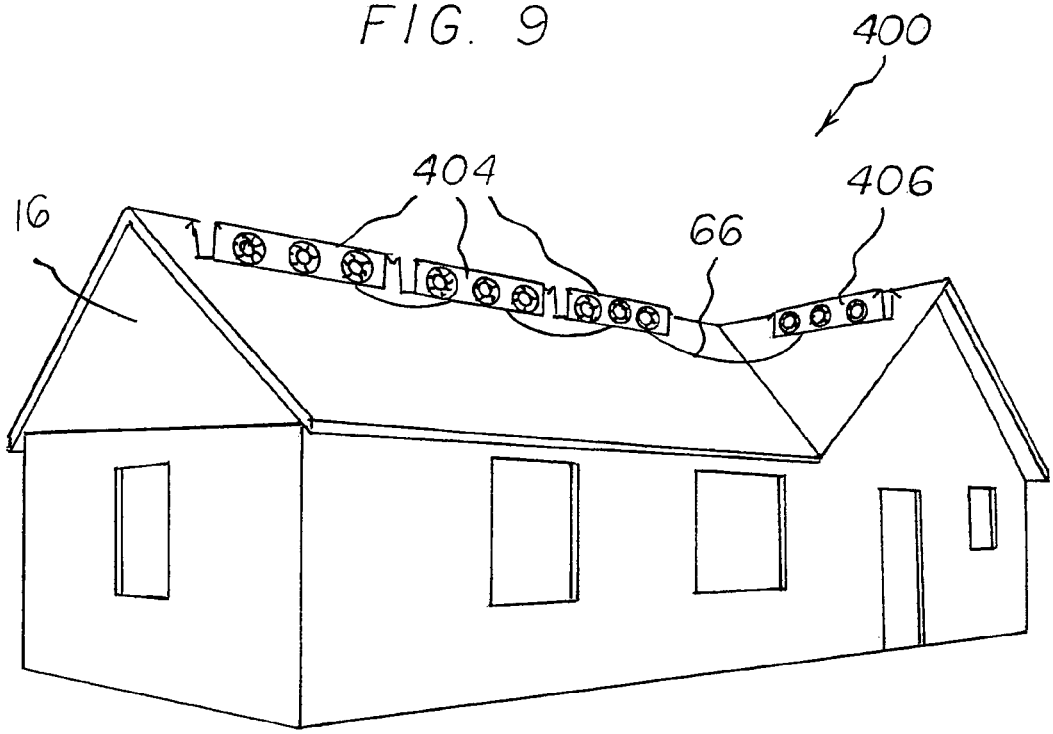
FIG. 9 is a perspective illustration of the system of the prior Figures installed on plural roof sections.

With reference now to the drawings, and in particular to FIG. 1 thereof, the preferred embodiment of the new and improved attic ventilation system embodying the principles and concepts of the present invention and generally designated by the reference numeral 10 will be described.

The present invention, the attic ventilation system 10 is comprised of a plurality of components. Such components in their broadest context include a ridge vent, a housing, fans and a power assembly. Such components are individually configured and correlated with respect to each other so as to attain the desired objective.

First provided is a building 14. The building has an attic 16 with a roof 18 there above. The roof has a ridge 20. An opening 22 is provided along at least a part of the ridge for the passage of warm air from the attic to exterior of the building. The roof is formed with trusses 24 having facing edges 26 adjacent to and spanning the ridge.

A housing 42 is illustrated in FIG. 2. The housing with the fans is properly called a module housing. A plurality of module housings is illustrated in FIGS. 1 and 9.

Next provided is a ridge vent 30 formed with an imperforate top 32 in an inverted V-shaped configuration above the opening to abate precipitation from entering the attic through the opening. The ridge vent has outwardly extending legs 34 below the opening positioned upon and supported by the roof and spanning the opening. Generally horizontal intermediate sections 36 couple the top and the legs. The intermediate sections are formed with holes 38 to allow the flow of warm air there through.

Next provided is a plurality of similarly configured housings 42 in axial alignment and positioned within the opening. Each housing is formed with a horizontally oriented rectangular base 44 and with upstanding first and second side walls 46, 48. A plurality of laterally spaced circular apertures 50 are provided in each first side wall for the flow of warm air there through. The base and the side walls are imperforate except for the apertures. The first and second walls are angled outwardly from the base at an angle of less than 5 degrees from vertical. The side walls are formed with outwardly facing flanges 52 positionable upon and supported by the roof and spanning the opening and beneath the legs of the ridge vent. The base and the side walls and the flanges are fabricated of aluminum. Each housing has parallel end walls 54 fabricated of a foam elastomer. The housing is adapted to be contracted during installation to facilitate placement into the opening.

Next provided is a plurality of tube-axial microfans 58. Fasteners 60 secure each microfan to the interior side wall of an associated housing. The microfans are in alignment with an associated aperture.

Lastly, a power assembly is provided. The power assembly includes a source of potential 64 and cables 66 coupling the fans in series to the source of potential. A thermostat 68 couples the source of potential and the fans to activate and inactivate the fans. The fans when inactivated restrict the flow of warm air. The fans when activated cause a flow of warm air from the attic and through the apertures in the housing and through the fan and into the ridge vent and through the holes of the intermediate section and to atmosphere.

The present invention includes a plurality of alternate embodiments of the invention. One alternate embodiment is the system 100 wherein the source of potential includes at least one solar panel 104 for powering the fans. Note FIG. 8.

The system 200 is another alternate embodiment wherein the fans are centrifugal fans 204. Note FIG. 5.

FIG. 6 illustrates yet another embodiment. In such system 300, the fans are aligned in aligned modules 304.

It should be understood that any of a wide variety of fans are adapted to be utilized in the modules including tube-axial microfans, centrifugal fans, squirrel fans and equivalents thereof.

The last embodiment is illustrated in FIG. 9. In such embodiment the system 400 includes a plurality of housings, 404, 406. Such housings are arranged in two axial alignments perpendicular to each other.

As may be understood from the above descriptions, the present invention provides a device and method for effectively ventilating and/or reducing the air temperature in attic spaces through use of an array of fan modules installed at a location at or near the ridge vent. In one embodiment, the fan modules comprise tube-axial microfans. In a further embodiment, the installation is immediately below the ridge vent. Preferably, the modules are disposed in the roof opening which is part of the ridge vent. In some embodiments, the modules are distributed along the entire structure, thus providing uniform cooling. Each module can comprise a small flange which can rest on the roof deck enabling the suspension of the fans through the ridge vent opening such that they drop into the heated attic space. In some embodiments the system comprises an array comprising in the range of from about 3 to 10 modules, depending upon the attic volume. Each module comprises 2-4, or preferably 3 or 4 microfans. The compact design of the modules of the present invention allows for installation in most commercially used roof ridge vent designs, which comprise limited openings, often as small as 3 inches.

In one embodiment, two or more of the modules are connected in series using low voltage, plug-N-play cables. The present inventive system also provides extraordinary power efficiency, which in some embodiments can be less than 20 watts per module, with large amounts of air ventilated to the outside. For example, overall efficiencies in the range of from 10-15 cubic feet per minute of heated air per watt of power used can be attained. The low power requirement allows for the powering of the modules via small solar panels, or in other embodiments the modules can be plugged into a typical attic light bulb socket.

In one embodiment, one or more of the fans are tube-axial fans. The fans can have diameters in the range of from about 4 inches to about 12 inches.

In one embodiment, the inventive system comprises three components: One or more fan modules, connector cables, and a controller/power supply.

This invention offers many benefits that are not available with other attic ventilation systems. The inventive design provides even air flow throughout the attic. The design offers the cooling attic spaces, such as the use of low numbers of large fans, which are effective proximally, drawing air from areas local to the fan, while having only a minimum effectiveness in removing superheated air from attic spaces distal to the fans.

An additional advantage is that the design can be implemented in such a way that it requires only low electrical voltages in order to be effective. Components which require only low voltages, such as, for example, in the range of from about 6 to about 48 can be used. In one embodiment, the low voltage components comprise a small transformer which plugs into a power outlet of a standard light bulb socket. Such an arrangement obviates the need for additional wiring as with systems comprising fans which require higher voltages in order for the system to move a comparable volume of air.

Furthermore, the installation of a cooling system according to the inventive design requires, in many cases, only a minimum degree of alteration to existing ridge vent structures. In many cases, the modules can be designed to fit into the existing ridge opening. The present inventive design thus minimizes or eliminates the need for skilled craftsmen to alter or adapt the roof ridge vent by widening, or the cutting of additional openings in the roof deck.

Moreover, the present inventive design can also preserve the aesthetic appeal of the roof because the component modules can be installed into the existing roof openings. This is in contrast to many other fan-based ventilation and cooling systems, which can require the installation of structures which can clutter the roof surface with protruding boxes or domes.

Yet another advantage of the inventive design is that, in many embodiments, access to the roof through the attic is not necessary for installation or maintenance of the attic ventilation/cooling system. In the preferred embodiment, installation is achieved by simply dropping the housings with their fans into the ridge vent opening. Further, the fans can be powered by a solar collector, which can be located on the roof. In other embodiments, the system can be powered via a power cable, which can, if desired, be pulled through a soffit to any inside or outside receptacle or light socket.

One of the primary advantages of the present inventive design is that, in most embodiments, it can be easily and economically installed, in contrast to many present systems which require greater expenditures of time and money. With insertion into the ridge vent, it is not necessary to turn the fan such that it faces upward. It is possible to achieve surprising ventilation and cooling efficiency even though the fan is in a vertical plane, parallel to the axis of the roof, rather than positioned such that it blows superheated air directly upward, and out of the ridge vent.

The fans are employed as part of installable modules. The modules can be constructed of sturdy materials which preferably have a degree of resistance to rot or corrosion. Plastic and metallic materials can be used, but preferred are metal materials, such as for example, aluminum or steel. In one embodiment, the modules are constructed of a commonly available gauge of aluminum, such as aluminum which is 0.015 of an inch thick, which offers flexibility for openings with uneven or variable width, as well as the durability to withstand high temperatures and other difficult conditions for many years of service. In one embodiment, the module comprises internal baffles between the fans to prevent cross flow and cavitations which could reduce air flow and fan efficiency. In one embodiment, the baffles completely separate the fans.

In other embodiments, the degree of partitioning is incomplete, for example, the baffles are perforated and/or they do not fully separate the fans. In one embodiment, each module is a convenient standard length. For example, the modules can be of such a length that they fit between the structural members of the roof. For example, in order to accommodate standard spacings between roof trusses, each module can be about 21-48 inches in length (FIG. 2) which roof deck or open span metal, so there is no need for attachment to any structural support members. Smaller modules down to 21 inches in length are preferred for residential and light commercial applications. Larger modules up to 48 inches in length are preferred for larger industrial applications.

In more specific embodiments, the specifications for the fans used in the modules include the following. The fan blades are of plastic material construction, having a diameter in the range of from about 4 to about 6 inches. The fan motor is a 6-48 volt motors, having a maximum power which is less than about 10 watts, with a service life in the range of from 50-70K hours, which for the present application, gives an actual life of about 14 years. The air-moving efficiency gives an air flow in the range of from about 80 to about 300 cubic feet per minute and can be axial or centrifugal.

The power cables which directly or indirectly connect the modules to the power supply are braided copper wire having a gauge in the range of from about 12 to about 18 gauge.

In further embodiments, the power cables comprise polarity-protected plug-N-play connectors. The protected connectors provide easy installation and prevent installation errors that cause damage to the power supply or fan motors.

In a further embodiment, the power is partially or fully supplied, either directly or indirectly, via small solar panels. In yet further embodiments, the solar panels attach to the top of the ridge vents, such that the roof appeal is relatively unchanged. In another embodiment, the initial installation is more economical with the power supply being a standard 50-200 watt power supply. In either case, it is preferred that a thermostat also be incorporated to control the system operation time as well as the degree to which the system lowers the temperature of the attic space. Optional features include thermostats timers and the like.

The Figures depict an exemplary placement of modules along a ridge vent. In the illustrated embodiments, each module comprises three fans, and the ridge vent gap, roof opening, is in the range of from about 3 inches for residential and light commercial applications up to about 8 inches for larger industrial applications. All measurements are merely exemplary.

The Figures also depict an exemplary placement of a module in a roof opening which is part of a ridge vent. Depicted is the placement of a module between roof support trusses. Note that the sizes of the module and the roof components are not necessarily to scale as depicted. All measurements are merely exemplary.

In addition, the Figures depict the placement of solar panels on the exposed side of the ridge vent covering. The solar panels can be used to generate electricity to power the module fan elements. Note FIG. 8. FIG. 1 is a drawing of an overhead view while FIG. 3 is essentially a view taken down the long axis of the ridge vent.

In all of the drawings, given measurements and measurement ranges are merely exemplary.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An attic ventilation system (10) for evacuating hot air from an attic space of a building through a roof ridge vent and for maintaining the attic space at a reduced temperature for abating the need for air conditioning with attendant power consumption, the evacuating and maintaining and abating being done in a safe, convenient and economical manner, the system comprising, in combination:

a building (14) having an attic (16) with a roof (18) there above, the roof having a ridge (20) with an opening (22) along at least a part of the ridge for the passage of warm air from the attic to exterior of the building, the roof being formed with trusses (24) having facing edges (6) adjacent to and spanning the ridge;

a ridge vent (30) formed with an imperforate top (32) in an inverted V-shaped configuration above the opening to abate precipitation from entering the attic through the opening, the ridge vent having outwardly extending flanges (34) below the opening positioned upon and supported by the roof and spanning the opening, horizontal intermediate sections (36) coupling the top and the flanges, the intermediate sections being formed with holes (38) to allow the flow of warm air there through;

a plurality of module housings (42) in axial alignment and positioned within the opening (22), the module housing being formed with a horizontally oriented rectangular base (44) and with upstanding first and second side walls (46) (48), a plurality of laterally spaced circular apertures (50) in each first side wall for the flow of warm air there through, the base and the side walls being imperforate except for the apertures, the first and second walls angled outwardly from the base at an angle of less than 5 degrees from vertical, the side walls being formed with outwardly facing tabs (52) positionable upon and supported by the roof and spanning the opening and beneath the flanges of the ridge vent, the base and the side walls and the tabs being fabricated of aluminum, each housing having parallel end walls (54) fabricated of a foam elastomer, the module housing being formed with a top portion having a width greater than the width of the module housing beneath the top portion such that the module housing can be dropped into the opening from above in anticipation of operation and use, the module housing adapted to be contracted during installation to facilitate placement into the opening, the opening being in a horizontal plane with a rectangular periphery, the tabs being supported in the horizontal plane conforming to the rectangular periphery of the opening during operation and use;

a plurality of tube-axial or centrifugal microfans (58), fasteners (60) securing each microfans to the interior side wall of an associated housing, the microfans being in alignment with an associated aperture, the microfans being laterally spaced with parallel axes; and a power assembly including a source of potential (64) and cables (66) coupling the fans in series to the source of potential, a thermostat (68) coupling the source of potential and the fans to activate and inactivate the fans, the fans when inactivated restricting a flow of warm air, the fans when activated causing a flow of warm air from the attic and through the apertures in the housing and through the fan and into the ridge vent and through the holes of the intermediate section and to atmosphere.

* * * * *